US012693009B2

(12) United States Patent
Kwon et al.

(10) Patent No.: US 12,693,009 B2
(45) Date of Patent: Jul. 28, 2026

(54) ARTIFICIAL INTELLIGENCE-BASED OPTIMAL AIR DAMPER CONTROL SYSTEM AND METHOD FOR INCREASING ENERGY EFFICIENCY OF INDUSTRIAL BOILERS

(71) Applicant: Korea Electronics Technology Institute, Seongnam-si (KR)

(72) Inventors: Ki Woong Kwon, Seoul (KR); Seung Hyeon Park, Yongin-si (KR); Sang Hun Kim, Suwon-si (KR); Dong Jin Yang, Suwon-si (KR)

(73) Assignee: Korea Electronics Technology Institute, Seongnam-si (KR)

( * ) Notice: Subject to any disclaimer, the term of this patent is extended or adjusted under 35 U.S.C. 154(b) by 384 days.

(21) Appl. No.: 18/384,202

(22) Filed: Oct. 26, 2023

(65) Prior Publication Data

US 2024/0191871 A1 Jun. 13, 2024

(30) Foreign Application Priority Data

Dec. 9, 2022 (KR) ..... 10-2022-0171063

(51) Int. Cl.
*F22B 35/00* (2006.01)
*F22B 35/18* (2006.01)

(52) U.S. Cl.
CPC ..... *F22B 35/001* (2013.01); *F22B 35/18* (2013.01)

(58) Field of Classification Search
CPC ..... F22B 35/001; F22B 35/18; F22B 35/00; F23N 3/002; F23N 3/00; F23N 2235/06; F23N 2241/10; G06N 20/00
See application file for complete search history.

(56) References Cited

U.S. PATENT DOCUMENTS

2006/0178762 A1* 8/2006 Wroblewski ..... G05B 13/027 700/36
2007/0142975 A1* 6/2007 Piche ..... H02J 3/38 700/286

(Continued)

FOREIGN PATENT DOCUMENTS

JP 58-195702 A 11/1983
KR 10-2108015 B1 5/2020
KR 10-2021-0157702 A 12/2021

OTHER PUBLICATIONS

Shah, Sunit, and D. M. Adhyaru. "Boiler efficiency analysis using direct method." 2011 Nirma university international conference on engineering. IEEE, 2011 (Year: 2011).*

(Continued)

*Primary Examiner* — Christopher E. Everett
(74) *Attorney, Agent, or Firm* — NSIP Law

(57) ABSTRACT

There is provided an AI-based air damper control system and method for industrial boilers. An AI-based optimal air damper control method according to an embodiment calculates energy efficiency under a given control condition and an environment by extracting energy efficiency-related data from industrial boiler operational data and analyzing a correlation between corresponding data, trains an AI-based optimal air volume-for-load prediction model by using the extracted data and the calculated energy efficiency as training data, and derives an air volume condition that results in peak energy efficiency under a given load, based on the trained optimal air volume-for-load prediction model, and automatically controls the air damper according to the corresponding air volume condition.

17 Claims, 6 Drawing Sheets

(56) References Cited

U.S. PATENT DOCUMENTS

| | | | | |
|---|---|---|---|---|
| 2007/0156288 | A1* | 7/2007 | Wroblewski | G05B 13/042 700/266 |
| 2007/0234781 | A1* | 10/2007 | Yamada | G05B 13/0265 73/23.2 |
| 2007/0250215 | A1* | 10/2007 | Jia | G05B 13/048 700/274 |
| 2009/0132095 | A1* | 5/2009 | Sekiai | G05B 13/027 700/47 |
| 2020/0173649 | A1* | 6/2020 | Maeng | F22B 35/18 |
| 2020/0320237 | A1* | 10/2020 | Na | G06N 3/0499 |
| 2021/0142171 | A1* | 5/2021 | Jung | G06N 3/048 |

OTHER PUBLICATIONS

Korean Office Action issued on Jul. 29, 2024, in counterpart Korean Patent Application No. 10-2022-0171063 (6 pages in English, 7 pages in Korean).

* cited by examiner

BOILER EFFICIENCY-RELATED DATA ANALYSIS

BOILER EFFICIENCY-RELATED DATA ANALYSIS

| AIR DAMPER INPUT VALUE | ENERGY EFFICIENCY PREDICTION |
|---|---|
| 50 | 60 |
| 60 | 80 |
| 70 | 90 |
| 80 | 70 |

ARTIFICIAL INTELLIGENCE-BASED OPTIMAL AIR DAMPER CONTROL SYSTEM AND METHOD FOR INCREASING ENERGY EFFICIENCY OF INDUSTRIAL BOILERS

CROSS-REFERENCE TO RELATED APPLICATION(S) AND CLAIM OF PRIORITY

This application is based on and claims priority under 35 U.S.C. § 119 to Korean Patent Application No. 10-2022-0171063, filed on Dec. 9, 2022, in the Korean Intellectual Property Office, the disclosure of which is herein incorporated by reference in its entirety.

BACKGROUND

Field

The disclosure relates to a system and a method for controlling an air damper of an industrial boiler, and more particularly, to a system and a method for controlling an air damper based on artificial intelligence (AI).

Description of Related Art

In related-art industrial boilers, an optimal air volume-for-load that is derived through experiments before boilers are installed on sites is uniformly applied to boilers of the same model. To this end, industrial boilers may be operated under the same condition even if they are installed on different sites.

However, an air volume-for-load condition derived through experiments may be an optimal condition in an experimental environment, but may vary in an ever-changing environment of an installation site.

That is, even industrial boilers of the same type may have a deviation in energy efficiency depending on characteristics of sites, and accordingly, there is a need for a technology for deriving an optimal air volume-for-load that meets a different site condition, and reducing energy consumption by controlling an air damper of an industrial boiler based on the optimal air volume-for-load.

SUMMARY

The disclosure has been developed in order to solve the above-described problems, and an object of the disclosure is to provide an AI-based optimal air damper control system and method which predicts energy efficiency under a given control condition (an air volume, a quantity of fuel, etc.) and an environment (a pressure, a temperature of feed water, etc.), by extracting energy efficiency-related data from industrial boiler operational data and analyzing a correlation between corresponding data.

Another object of the disclosure is to provide an AI-based optimal air damper control system and method which derives an air volume condition that results in peak energy efficiency under a given load (a quantity of fuel), based on a result of predicting energy efficiency, and automatically controls an air damper according to the corresponding air volume condition.

According to an embodiment of the disclosure to achieve the above-described objects, an AI-based optimal air damper control method may include: a first step of collecting, by a system, industrial boiler operational data; a second step of calculating, by the system, energy efficiency under a given control condition and an environment by extracting energy efficiency-related data from the collected industrial boiler operational data and analyzing a correlation between corresponding data; a third step of training, by the system, an optimal air volume-for-load prediction model which is based on AI, by using the extracted data and the calculated energy efficiency as training data; and a fourth step of deriving, by the system, an air volume condition that results in peak energy efficiency under a given load, based on the trained optimal air volume-for-load prediction model, and automatically controlling an air damper according to the corresponding air volume condition.

The collected industrial boiler operational data may include a quantity of feed water, a temperature of feed water, a quantity of fuel used, a boiler pressure, an exhaust gas NOx, O2, an exhaust gas temperature, an air damper input value, and a fuel damper input value.

In addition, the second step may include calculating the energy efficiency by referring to Equation 2 presented below:

Equation 2

$$\text{Boiler Efficiency} = \frac{\text{Heat Output}}{\text{Heat Input}} \times 100 = \frac{\text{Quantity of Feed Water} \times (\text{Enthalpy of Steam} - \text{Temperature of Feed Water})}{\text{Calorific Value of Fuel} \times \text{Quantity of Fuel used}} \times 100$$

In addition, the second step may include, when energy efficiency is calculated by referring to Equation 2 above, using a heat transfer value for a boiler pressure in a saturated steam table as the enthalpy of steam, and using a higher heating value of fuel used by the boiler as the calorific value of fuel.

In addition, the third step may include, when training the optimal air volume-for-load prediction model, using, as training data, energy efficiency-related data including a boiler pressure, a quantity of fuel used (load), a temperature of feed water, an air damper input value, and the calculated energy efficiency (boiler efficiency).

In addition, the third step may include, when performing pre-processing on the training data, determining, as an abnormal data value, an efficiency value that is calculated when a boiler is turned off after water is drained off from a boiler water tank and steam is generated, and water supply is late, and excluding the abnormal efficiency value from the training data.

In addition, the optimal air volume-for-load prediction model may construct an artificial neural network that is comprised of three hidden layers and four neurons per hidden layer, and may use an ELU as an activation function.

In addition, the fourth step may include, when using the trained optimal air volume-for-load prediction model, fixing a quantity of fuel used, a temperature of feed water, a boiler pressure, and changing only an air damper input value within an allowable range, and predicting boiler efficiency according to a change in the air damper input value, and using an air damper input value based on which peak boiler efficiency is predicted for automatically controlling the air damper.

In addition, the system may not perform the first step to the third step on a one-time basis, and, when new industrial boiler operational data is collected, may periodically refine the optimal air volume-for-load prediction model by adding the new industrial boiler operational data to the training data.

According to another embodiment of the disclosure, an AI-based optimal air damper control system may include: a communication unit configured to collect industrial boiler operational data; and a processor configured to calculate energy efficiency under a given control condition and an environment by extracting energy efficiency-related data from the collected industrial boiler operational data and analyzing a correlation between corresponding data, to train an optimal air volume-for-load prediction model which is based on AI, by using the extracted data and the calculated energy efficiency as training data, and to derive an air volume condition that results in peak energy efficiency under a given load, based on the trained optimal air volume-for-load prediction model, and to automatically control an air damper according to the corresponding air volume condition.

According to still another embodiment of the disclosure, an AI-based optimal air damper control method may include: a step of training, by a system, an optimal air volume-for-load prediction model which is based on AI, by using energy efficiency-related data and a result of calculating energy efficiency as training data; and a step of deriving, by the system, an air volume condition that results in peak energy efficiency under a given load, based on the trained optimal air volume-for-load prediction model, and automatically controlling an air damper according to the corresponding air volume condition.

According to yet another embodiment of the disclosure, an AI-based optimal air damper control system may include: a storage unit configured to store an AI-based optimal air volume-for-load prediction model that is trained by using energy efficiency-related data and a result of calculating energy efficiency as training data; and a processor configured to derive an air volume condition that results in peak energy efficiency under a given load, based on the stored AI-based optimal air volume-for-load prediction model, and to automatically control an air damper according to the corresponding air volume condition.

According to embodiments of the disclosure as described above, by extracting energy efficiency-related data from industrial boiler operational data and analyzing a correlation between corresponding data, energy efficiency can be predicted under a given control condition (an air volume, a quantity of fuel, etc.) and an environment (a pressure, a temperature of feed water, etc.).

In addition, by deriving an air volume condition that results in peak energy efficiency under a given load (a quantity of fuel), based on a result of predicting energy efficiency, and automatically controlling an air damper according to the corresponding air volume condition, energy consumption in industrial boilers can be reduced.

Other aspects, advantages, and salient features of the invention will become apparent to those skilled in the art from the following detailed description, which, taken in conjunction with the annexed drawings, discloses exemplary embodiments of the invention.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Hereinafter, the disclosure will be described in more detail with reference to the accompanying drawings.

When a related-art industrial boiler is installed on a site, the industrial boiler may be operated with an air volume being fixed against a load. However, an AI-based optimal air bumper control system (hereinafter, referred to as a "system") according to an embodiment of the disclosure may continuously derive an optimal air volume-for-load that suits a site environment by analyzing operational data of a site even after an industrial boiler is installed, and may automatically control an air damper based on the derived optimal air volume-for-load.

To achieve this, the system according to an embodiment may predict energy efficiency under a given control condition (an air volume, a quantity of fuel, etc.) and an environment (a pressure, a temperature of feed water, etc.) by extracting energy efficiency-related data from industrial boiler operational data and analyzing a correlation between corresponding data, and may derive an air volume condition that results in peak energy efficiency under a given load (a quantity of fuel), based on a result of predicting energy efficiency, and may automatically control an air damper according to the corresponding air volume condition.

Figure 1:
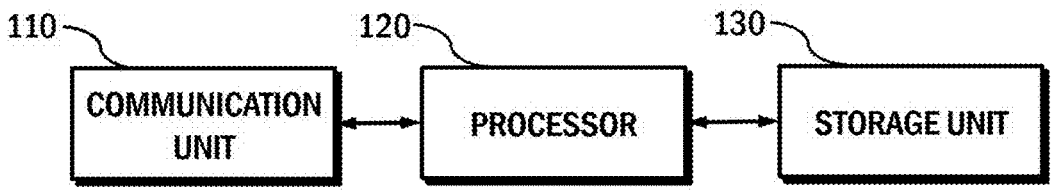
FIG. 1 is a view provided to explain a configuration of an AI-based optimal air damper control system according to an embodiment of the disclosure.
Figure 2:
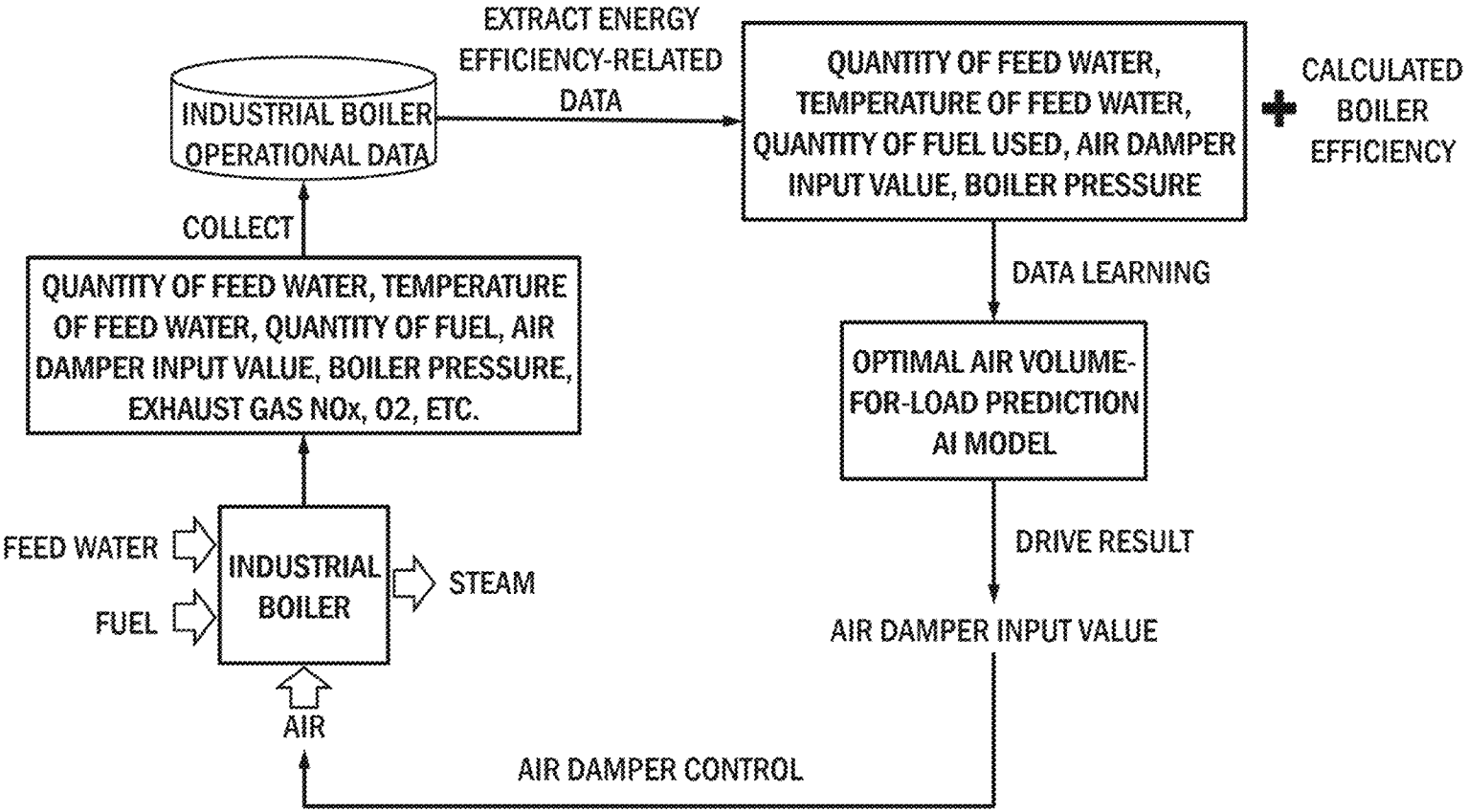
FIG. 2 is a view provided to explain operations of the AI-based optimal air damper control system according to an embodiment of the disclosure.
Figure 3:
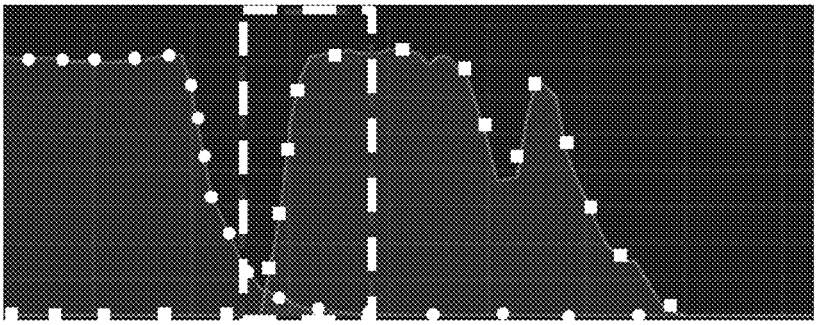
FIG. 3 is a view illustrating a state in which abnormally high energy (boiler) efficiency is calculated when energy (boiler) efficiency is calculated through the AI-based optimal air damper control system according to an embodiment of the disclosure.
Figure 4:
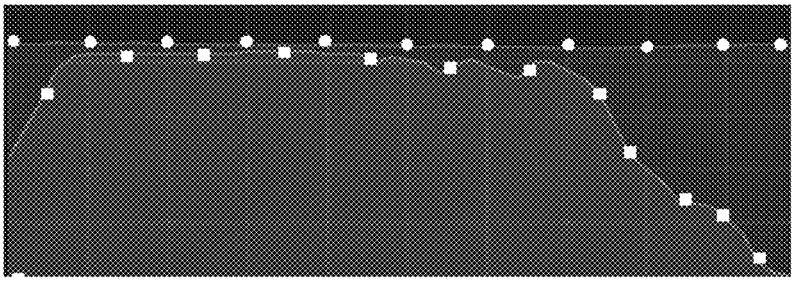
FIG. 4 is a view illustrating a state in which energy (boiler) efficiency is normally calculated when energy (boiler) efficiency is calculated through the AI-based optimal air damper control system according to an embodiment of the disclosure.

FIG. 1 is a view provided to explain a configuration of a system according to an embodiment of the disclosure, FIG. 2 is a view provided to explain operations of the system according to an embodiment, FIG. 3 is a view illustrating a state in which abnormally high energy (boiler) efficiency is calculated when energy (boiler) efficiency is calculated through the system according to an embodiment, and FIG. 4 is a view illustrating a state in which energy (boiler) efficiency is normally calculated.

Referring to FIG. 1, the system may include a communication unit 110, a processor 120, and a storage 130.

The communication unit 110 may be connected to an IoT device installed in an industrial boiler to collect industrial boiler operational data that is generated in the industrial boiler.

The storage unit 130 is a storage medium that stores a program and data necessary for operating the processor 120.

For example, the storage unit 130 may store industrial boiler operational data which is collected through the communication unit 110, and an optimal air volume-for-load prediction model that is trained by the processor 120.

The processor 120 may process various matters necessary for operating the system.

For example, the processor 120 may extract energy efficiency-related data from the collected industrial boiler operational data, may calculate energy efficiency under a given control condition and an environment by analyzing a correlation between corresponding data, and may train the optimal air volume-for-load prediction model, which is based on AI, by using the extracted data and the calculated energy efficiency as training data.

In addition, the processor 120 may derive an air volume condition that results in peak energy efficiency under a given load, based on the trained optimal air volume-for-load prediction model, and may automatically control an air damper according to the corresponding air volume condition.

Herein, the collected industrial boiler operational data may include a quantity of feed water, a temperature of feed water, a quantity of fuel used, a boiler pressure, exhaust gas NOx, O2, an exhaust gas temperature, an air damper input value, and a fuel damper input value.

Energy (boiler) efficiency of an industrial boiler may be calculated by referring to Equation 1 presented below:

Equation 1

$$\text{Boiler Efficiency} = \frac{\text{Heat Output}}{\text{Heat Input}} \times 100 = \frac{\text{Quantity of Steam generated} \times (\text{Enthalpy of Steam} - \text{Enthalpy of Feed Water})}{\text{Calorific Value of Fuel} \times \text{Quantity of Fuel used}} \times 100$$

However, a quantity-of-steam-generated measurement sensor is high priced and hence there is hardly an industrial boiler having a corresponding sensor installed therein. It is practically impossible to accurately measure a quantity of steam generated.

Accordingly, when calculating energy efficiency by referring to Equation 1, the processor 120 assumes that all the water supplied to a boiler is converted into steam, and uses a quantity of feed water instead of a quantity of steam generated which is collected at a high-priced quantity-of-steam-generated measurement sensor.

In addition, the processor 120 may use a temperature of feed water instead of enthalpy of feed water since enthalpy of feed water under 100° C. is almost the same as a temperature of feed water.

That is, the processor 120 may calculate energy efficiency by referring to Equation 2 presented below:

Equation 2

$$\text{Boiler Efficiency} = \frac{\text{Heat Output}}{\text{Heat Input}} \times 100 = \frac{\text{Quantity of Feed Water} \times (\text{Enthalpy of Steam} - \text{Temperature of Feed Water})}{\text{Calorific Value of Fuel} \times \text{Quantity of Fuel used}} \times 100$$

When calculating energy efficiency by referring to Equation 2, the processor 120 may use a heat transfer value for a boiler pressure in the saturated steam table as enthalpy of steam, and may use a higher heating value of fuel used in the boiler as a calorific value of fuel.

Additionally, when boiler efficiency is calculated, a lower heating value may be used as a calorific value of fuel. However, according to KS B 6205 standard, use of a gross calorific value of fuel, that is, a higher heating value, is recommended, and accordingly, in the disclosure, a higher heating value is used when boiler efficiency is calculated.

In fact, a calorific value has a fixed value for each fuel and is not a factor that influences change in boiler efficiency, and thus, a calorific value does not influence a result of predicting boiler efficiency even if anyone of a lower heating value or a higher heating value is selected.

The enthalpy of steam is determined according to a boiler pressure, the calorific value of fuel is fixed for each fuel, and the quantity of feed water is a value that is generated under control of the boiler. Therefore, a boiler pressure, a quantity of fuel used (load), a temperature of feed water may be basically included as boiler efficiency-related data.

In addition, since an object of the disclosure is to derive an air volume resulting in peak efficiency under a given load, an air damper input value for adjusting an air volume may also be included as related data. That is, data related to boiler efficiency includes a boiler pressure, a quantity of fuel used (load), a temperature of feed water, an air damper input value, calculated boiler efficiency.

Accordingly, the processor 120 may extract, from boiler operational data, energy efficiency-related data including a boiler pressure, a quantity of fuel used (load), a temperature of feed water, and an air damper input value, and calculated energy efficiency (boiler efficiency), and may use the extracted data as training data for training an AI model (the optimal air volume-for-load prediction model).

Meanwhile, when the processor 120 calculates boiler efficiency, a boiler efficiency value may be calculated as an abnormally high value due to a difference between a steam generation time and a water feeding time. In this case, a data value may be excluded from training data when pre-processing is performed on the training data.

Specifically, when a boiler is turned off and water supply (graph □) starts at a time a quantity of fuel used (graph ○) is reduced, the quantity of fuel used which is in the denominator of Equation 2 is close to 0, so that an abnormally high boiler efficiency value may be calculated.

For example, when a boiler is turned off right after water is drained off from a boiler water tank and steam is generated, water supply may be late, so that an abnormal efficiency value may be calculated.

That is, the corresponding problem may not arise if it is possible to directly measure a quantity of steam in real time, but as mentioned above, it is practically impossible to measure a quantity of steam and hence it is deemed that the corresponding problem arises as a quantity of feed water with a time lag is used instead.

Accordingly, in performing pre-processing on training data, the processor 120 may convert the quantity of fuel used and the quantity of feed water into quantities added for one hour only when fuel consumption is stable and water is supplied in this state as shown in FIG. 4, and may use the added quantities as training data, and may determine, as an abnormal data value (a factor that degrades accuracy of a prediction model), an efficiency value that is calculated when the boiler is turned off after water is drained off from the boiler water tank and steam is generated, and thus, water supply is late as shown in FIG. 3, and may exclude the abnormal efficiency value from training data.

Figure 5:
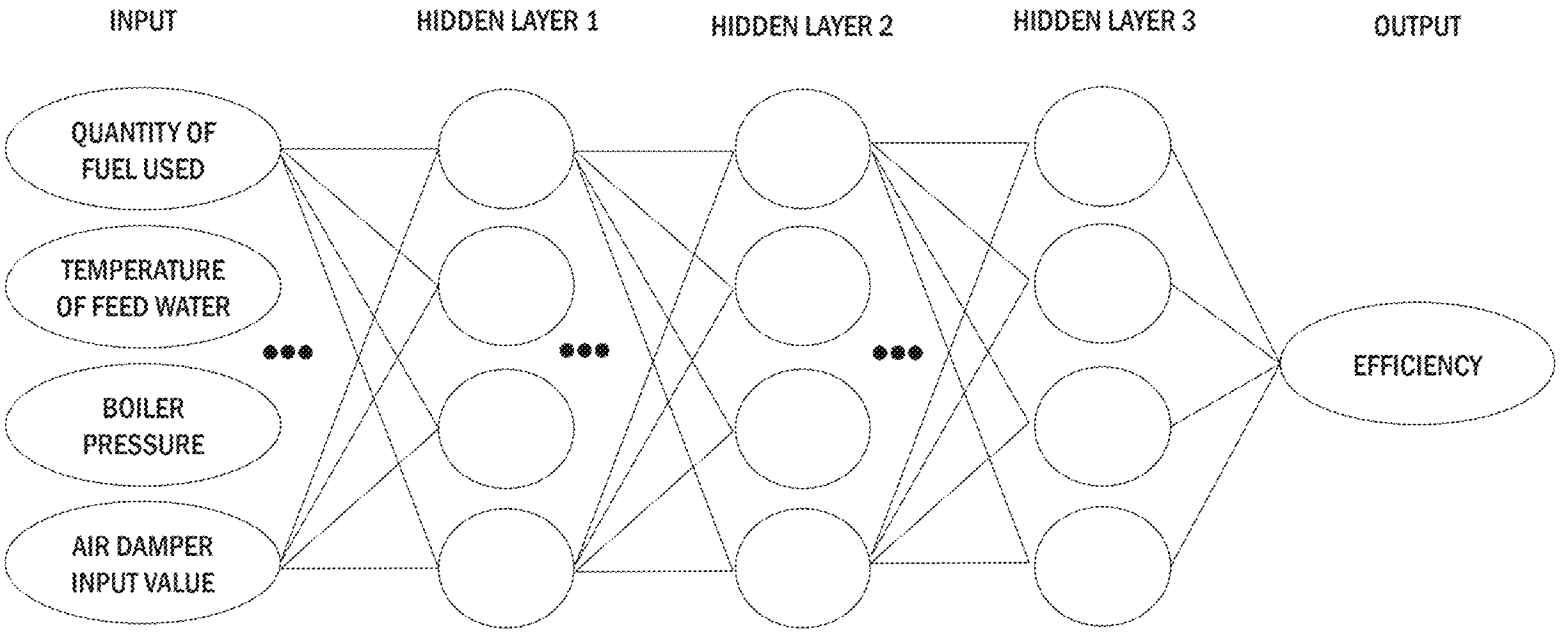
FIG. 5 is a view provided to explain a structure of an optimal air volume-for-load prediction model according to an embodiment.

FIG. 5 is a view provided to explain a structure of the optimal air volume-for-load prediction model according to an embodiment.

As described above, the processor 120 may train the AI-based optimal air volume-for-load prediction model by using energy (boiler) efficiency-related data which undergoes data pre-processing, and calculated energy efficiency as training data.

In this case, the optimal air volume-for-load prediction model may constructure an artificial neural network which is comprised of three hidden layers and four neuron per hidden layer as shown in FIG. 5.

The optimal air volume-for-load prediction model may use an exponential linear unit (ELU) as an activation function.

The ELU is similar to ReLU in its shape, but, since a point at which an input value is 0 is not a sharp point, the ELU may differentiate at 0 and may be a function that makes all the output of input under 0 converge to 0, not 0.

The optimal air volume-for-load prediction model trained by the artificial neural network may predict energy (boiler) efficiency when a quantity of fuel used (load), a temperature of feed water, a boiler pressure, an air damper input value are inputted as an input.

Figure 6:
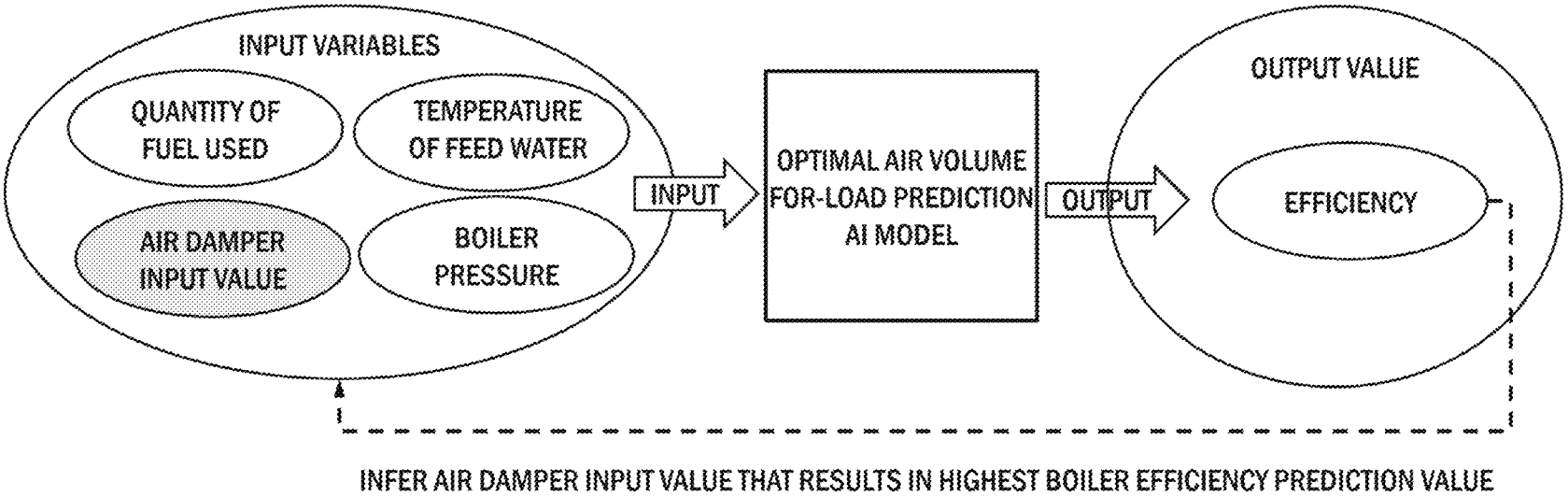
FIG. 6 is a view provided to explain a process of inferring an air damper input value that results in peak energy (boiler) efficiency through the AI-based optimal air damper control system according to an embodiment of the disclosure.

FIG. 6 is a view provided to explain a process of inferring an air damper input value that results in peak energy (boiler) efficiency through the system according to an embodiment.

The processor 120 may derive an air volume condition that results in peak energy efficiency under a given load, based on the optimal air volume-for-load prediction model, and may automatically control an air damper according to the corresponding air volume condition.

Specifically, the processor 120 may fix a quantity of fuel used, a temperature of feed water, a boiler pressure in the optimal air volume-for-load prediction model, and may change only an air damper input value within an allowable range, and may predict boiler efficiency according to a change in the air damper input value, and may use an air damper input value based on which peak boiler efficiency is predicted for automatic control of the air damper.

For example, when the air damper input value is 70, peak boiler efficiency of 90 may be obtained as shown in FIG. 6. In this case, the processor 120 may set the air damper input value to 70 and may deliver a control command to the boiler.

In addition, when new industrial boiler operational data is collected, the processor 120 may add the collected new industrial boiler operational data to training data, and may periodically refine the optimal air volume-for-load prediction model.

Specifically, the processor 120 may collect and store new industrial boiler operational data until a predetermined update period comes in, and may add the stored new industrial boiler operational data to training data when the predetermined update period comes in, and may periodically refine the optimal air volume-for-load prediction model.

Figure 7:
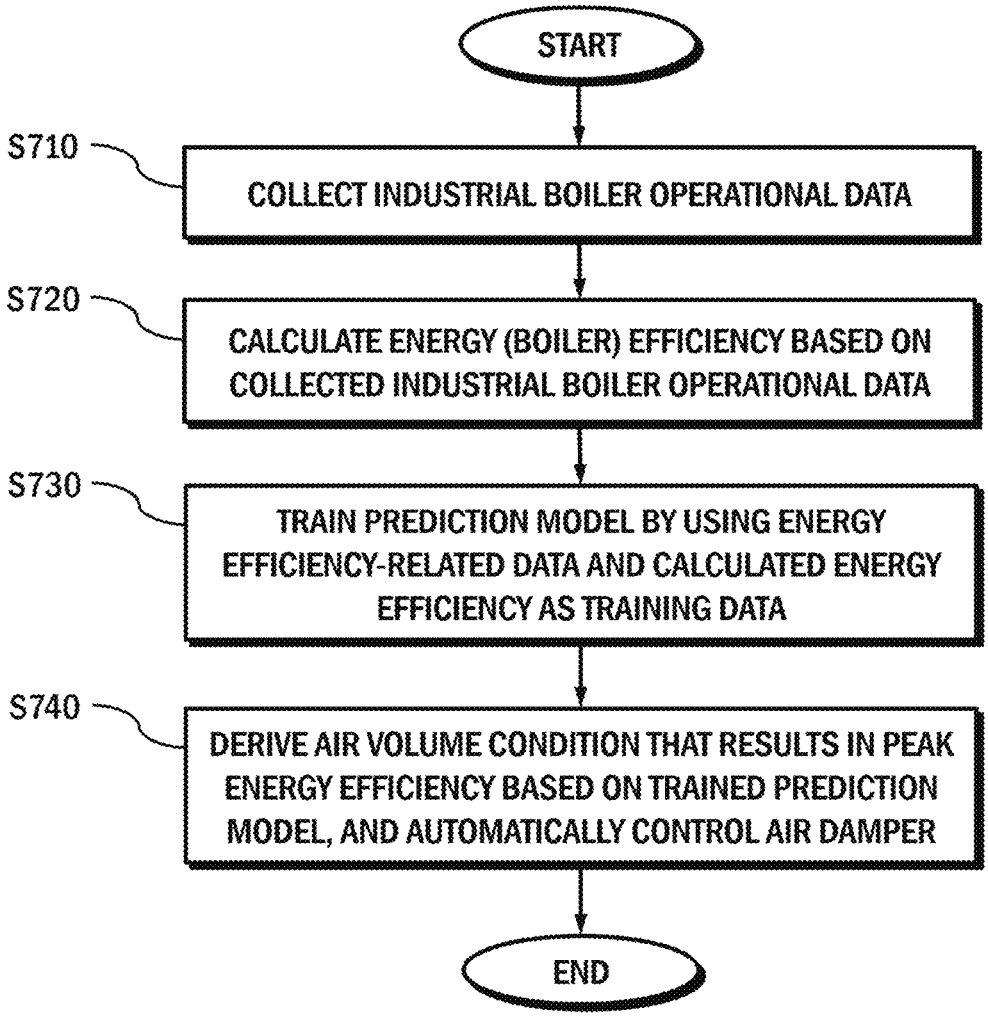
FIG. 7 is a flowchart provided to explain an AI-based optimal air damper control method according to an embodiment of the disclosure.

FIG. 7 is a flowchart provided to explain an AI-based optimal air damper control method according to an embodiment.

The AI-based optimal air damper control method according to an embodiment may be executed by the system described above with reference to FIGS. 1 to 6.

Referring to FIG. 7, the AI-based optimal air damper control method may collect industrial boiler operational data (S710), may calculate energy efficiency under a given control condition and an environment by extracting energy efficiency-related data from the collected industrial boiler operational data and analyzing a correlation between corresponding data (S720), may train the AI-based optimal air volume-for-load prediction model by using the extracted data and the calculated energy efficiency as training data (S730), and may derive an air volume condition that results in peak energy efficiency under a given load, based on the trained optimal air volume-for-load prediction model, and may automatically control the air damper according to the corresponding air volume condition (S740). Through this method, energy consumption in industrial boilers may be reduced.

The AI-based optimal air damper control method does not perform steps S710 to S730 on a one-time basis, and may periodically refine the optimal air volume-for-load prediction model by adding new industrial boiler operational data to training data.

Specifically, the system may collect new industrial boiler operational data and store the same in a database of the storage unit 130 until a predetermined update period (for example, every Monday, the first day of every month) comes in, and may add the stored new industrial boiler operational data to training data when the predetermined update period comes in, thereby periodically refining the optimal air volume-for-load prediction model.

The technical concept of the present disclosure may be applied to a computer-readable recording medium which records a computer program for performing the functions of the apparatus and the method according to the present embodiments. In addition, the technical idea according to various embodiments of the present disclosure may be implemented in the form of a computer readable code recorded on the computer-readable recording medium. The computer-readable recording medium may be any data storage device that can be read by a computer and can store data. For example, the computer-readable recording medium may be a read only memory (ROM), a random access memory (RAM), a CD-ROM, a magnetic tape, a floppy disk, an optical disk, a hard disk drive, or the like. A computer readable code or program that is stored in the computer readable recording medium may be transmitted via a network connected between computers.

In addition, while preferred embodiments of the present disclosure have been illustrated and described, the present disclosure is not limited to the above-described specific embodiments. Various changes can be made by a person skilled in the at without departing from the scope of the present disclosure claimed in claims, and also, changed embodiments should not be understood as being separate from the technical idea or prospect of the present disclosure.

What is claimed is:

1. An AI-based optimal air damper control method comprising:

collecting, by a system, industrial boiler operational data;

calculating, by the system, energy efficiency under a given control condition and an environment by extracting energy efficiency-related data from the collected industrial boiler operational data and analyzing a correlation between corresponding data;

training, by the system, an optimal air volume-for-load prediction model which is based on AI, by using the extracted data and the calculated energy efficiency as training data; and deriving, by the system, an air volume condition that results in peak energy efficiency under a given load, based on the trained optimal air volume-for-load prediction model, and automatically controlling an air damper according to the corresponding air volume condition, wherein the controlling comprises, when using the trained optimal air volume-for-load prediction model, fixing a quantity of fuel used, a temperature of feed water, a boiler pressure, and changing only an air damper input value within an allowable range, and predicting boiler efficiency according to a change in the air damper input value, and using an air damper input value based on which peak boiler efficiency is predicted for automatically controlling the air damper.

2. The AI-based optimal air damper control method of claim 1, wherein the collected industrial boiler operational data includes a quantity of feed water, a temperature of feed water, a quantity of fuel used, a boiler pressure, an exhaust gas NOx, O2, an exhaust gas temperature, an air damper input value, and a fuel damper input value.

3. The AI-based optimal air damper control method of claim 1, wherein the calculating the energy efficiency comprises calculating the energy efficiency by referring to Equation 2 presented below:

Equation 2

$$\text{Boiler Efficiency} = \frac{\text{Heat Output}}{\text{Heat Input}} \times 100 = \frac{\text{Quantity of Feed Water} \times (\text{Enthalpy of Steam} - \text{Temperature of Feed Water})}{\text{Calorific Value of Fuel} \times \text{Quantity of Fuel used}} \times 100$$

4. The AI-based optimal air damper control method of claim 3, wherein the calculating the energy efficiency comprises, when energy efficiency is calculated by referring to Equation 2 above, using a heat transfer value for a boiler pressure in a saturated steam table as the enthalpy of steam, and using a higher heating value of fuel used by the boiler as the calorific value of fuel.

5. The AI-based optimal air damper control method of claim 3, wherein the training comprises, when training the optimal air volume-for-load prediction model, using, as training data, energy efficiency-related data including a boiler pressure, a quantity of fuel used (load), a temperature of feed water, an air damper input value, and the calculated energy efficiency (boiler efficiency).

6. The AI-based optimal air damper control method of claim 5, wherein the training comprises, when performing pre-processing on the training data, determining, as an abnormal data value, an efficiency value that is calculated when a boiler is turned off after water is drained off from a boiler water tank and steam is generated, and water supply is late, and excluding the abnormal efficiency value from the training data.

7. The AI-based optimal air damper control method of claim 5, wherein the optimal air volume-for-load prediction model is configured to construct an artificial neural network that is comprised of three hidden layers and four neurons per hidden layer, and to use an exponential linear unit (ELU) as an activation function.

8. The AI-based optimal air damper control method of claim 1, wherein the system does not perform the collecting, the calculating, and the training on a one-time basis, and, when new industrial boiler operational data is collected, periodically refines the optimal air volume-for-load prediction model by adding the new industrial boiler operational data to the training data.

9. An AI-based optimal air damper control system comprising:

one or more processors configured to:

collect industrial boiler operational data;

calculate energy efficiency under a given control condition and an environment by extracting energy efficiency-related data from the collected industrial boiler operational data and analyzing a correlation between corresponding data;

train an optimal air volume-for-load prediction model which is based on AI, by using the extracted data and the calculated energy efficiency as training data; and derive an air volume condition that results in peak energy efficiency under a given load, based on the trained optimal air volume-for-load prediction model, and to automatically control an air damper according to the corresponding air volume condition, wherein, for the controlling, the one or more processors are configured to, when using the trained optimal air volume-for-load prediction model, fix a quantity of fuel used, a temperature of feed water, a boiler pressure, and change only an air damper input value within an allowable range, and predict boiler efficiency according to a change in the air damper input value, and using an air damper input value based on which peak boiler efficiency is predicted for automatically controlling the air damper.

10. The AI-based optimal air damper control system of claim 9, wherein the collected industrial boiler operational data includes a quantity of feed water, a temperature of feed water, a quantity of fuel used, a boiler pressure, an exhaust gas NOx, O2, an exhaust gas temperature, an air damper input value, and a fuel damper input value.

11. The AI-based optimal air damper control system of claim 9, wherein, for the calculating the energy efficiency, the one or more processors are configured to calculate the energy efficiency by referring to Equation 2 presented below:

Equation 2

$$\text{Boiler Efficiency} = \frac{\text{Heat Output}}{\text{Heat Input}} \times 100 = \frac{\text{Quantity of Feed Water} \times (\text{Enthalpy of Steam} - \text{Temperature of Feed Water})}{\text{Calorific Value of Fuel} \times \text{Quantity of Fuel used}} \times 100$$

12. The AI-based optimal air damper control system of claim 11, wherein, for the calculating the energy efficiency, the one or more processors are configured to, when energy efficiency is calculated by referring to Equation 2 above, use a heat transfer value for a boiler pressure in a saturated steam table as the enthalpy of steam, and use a higher heating value of fuel used by the boiler as the calorific value of fuel.

13. The AI-based optimal air damper control system of claim 11, wherein, for the training, the one or more processors are configured to, when training the optimal air volume-for-load prediction model, use, as training data, energy efficiency-related data including a boiler pressure, a quantity of fuel used (load), a temperature of feed water, an air damper input value, and the calculated energy efficiency (boiler efficiency).

14. The AI-based optimal air damper control system of claim 13, wherein, for the training, the one or more processors are configured to, when performing pre-processing on the training data, determine, as an abnormal data value, an efficiency value that is calculated when a boiler is turned off after water is drained off from a boiler water tank and steam is generated, and water supply is late, and exclude the abnormal efficiency value from the training data.

15. The AI-based optimal air damper control system of claim 13, wherein the optimal air volume-for-load prediction model is configured to construct an artificial neural network that is comprised of three hidden layers and four neurons per hidden layer, and to use an exponential linear unit (ELU) as an activation function.

16. An AI-based optimal air damper control method comprising:

training, by a system, an optimal air volume-for-load prediction model which is based on AI, by using energy efficiency-related data and a result of calculating energy efficiency as training data; and deriving, by the system, an air volume condition that results in peak energy efficiency under a given load, based on the trained optimal air volume-for-load prediction model, and automatically controlling an air damper according to the corresponding air volume condition, wherein the controlling comprises, when using the trained optimal air volume-for-load prediction model, fixing a quantity of fuel used, a temperature of feed water, a boiler pressure, and changing only an air damper input value within an allowable range, and predicting boiler efficiency according to a change in the air damper input value, and using an air damper input value based on which peak boiler efficiency is predicted for automatically controlling the air damper.

17. The AI-based optimal air damper control system of claim 9, wherein the system does not perform the collecting, the calculating, and the training on a one-time basis, and, when new industrial boiler operational data is collected, periodically refines the optimal air volume-for-load prediction model by adding the new industrial boiler operational data to the training data.

* * * * *